US005228375A

United States Patent [19]

Harder

[11] Patent Number: 5,228,375

[45] Date of Patent: Jul. 20, 1993

[54] ADJUSTABLE STOP APPARATUS FOR REGISTER PUNCH

[75] Inventor: Willard J. Harder, Eden Prairie, Minn.

[73] Assignee: Ternes Register System Co., Eden Prairie, Minn.

[21] Appl. No.: 950,215

[22] Filed: Sep. 24, 1992

[51] Int. Cl.[5] ..... B26D 7/01; B26F 1/02

[52] U.S. Cl. ..... 83/468.8; 83/468.9; 83/522.18; 83/700

[58] Field of Search ..... 83/468.2, 468.7, 468.8, 83/468.9, 522.17, 522.18, 522.19, 522.24, 620, 700

[56] References Cited

U.S. PATENT DOCUMENTS

| | | | |
|---|---|---|---|
| 483,555 | 10/1892 | Hersey | 83/468.2 |
| 751,121 | 2/1904 | Tidey | 83/468.2 |
| 1,129,652 | 2/1915 | Dom | 83/468.2 |
| 1,504,248 | 8/1924 | Johnson | 83/468.2 |
| 1,660,929 | 2/1928 | Lee . | |
| 2,104,276 | 1/1938 | Schultz | 83/468.2 |
| 2,316,971 | 4/1943 | Overacker et al. | 83/468.1 |
| 2,482,218 | 9/1949 | Segal | 83/468.9 |
| 3,211,038 | 10/1965 | Lake et al. | 83/468.9 |
| 3,406,626 | 10/1968 | Ternes . | |
| 3,826,168 | 7/1974 | Groswith, III et al. | 83/468.2 |
| 4,151,768 | 5/1979 | Shockovsky | 83/468.9 |
| 4,529,303 | 7/1985 | Ternes | 355/91 |
| 4,563,085 | 1/1986 | Ternes | 355/132 |

*Primary Examiner*—Hien H. Phan

*Attorney, Agent, or Firm*—Burd, Bartz & Gutenkauf

[57] ABSTRACT

A register punch has a plurality of punch assemblies for making holes and notches in a sheet member. Adjustable stops located adjacent the punch assemblies cooperate with an edge of the sheet member to locate the sheet member relative to the punch assemblies. The stops have rotatable members with stop faces which provide a plurality of spaced stops for the sheet member.

24 Claims, 5 Drawing Sheets

ADJUSTABLE STOP APPARATUS FOR REGISTER PUNCH

FIELD OF THE INVENTION

The invention is in the field of machines for making holes in sheet members. The machines having gauges and adjustable stops to locate the sheet members relative to punching tools used to make holes in the sheet members.

BACKGROUND OF THE INVENTION

Pin registration systems are used in the printing industry to register printing plates and films for use on printing presses. Registration punches are used to make holes and notches in the edges of printing plates which are exactly located relative to art work so that no adjustment is required for registration. The registration punches must be adjusted to accommodate different locations of the holes and notches for use on different types of printing presses. A punch for making holes in printing plates is shown by N. A. Ternes in U.S. Pat. No. 3,406,262. This punch has a fixed stop for determining a first location of holes in printing plates and second stops provided by pivoted spaced arms to locate notches or half holes in the edges of printing plates. Registration punches have been provided with a plurality of pin stops located in holes in the boards of the punches to allow the operator of the punches to change the stop positions and thereby change the hole locations in printing plates. This is a manual operation which is time consuming and provides for a limited number of stop positions on the registration punch.

SUMMARY OF THE INVENTION

The invention is directed to an adjustable stop apparatus for a punch for placing at least one hole in a sheet member in a selected location. The selected location can be changed by adjusting the stop apparatus. The stop apparatus has a body mounted on the board of the punch to provide a slot for accommodating an edge portion of the sheet member to locate the sheet member relative to a punch mechanism operable to place at least one hole in the sheet member. A rotatable member mounted on the body has a front end facing the slot. The front end has a plurality of transverse faces circumferentially and longitudinally spaced from each other which provide a plurality of stops for aligning the edge portion of the sheet member with the punch mechanism in selected positions. The member having the stops is rotatably mounted on body and connected to a control which selectively rotates the member to locate a selected stop in a stop position. A holder retains the control in a selected position so that the stop is maintained in alignment with the edge portion of the sheet member during the punching of the hole therein.

A preferred embodiment of the adjustable stop apparatus is used with a register punch having a board with a top surface and a plurality of punches for placing holes in a sheet member, such as a printing plate or film, at selected locations. The stop apparatus has a body mounted on the board adjacent the punch mechanisms. The body has a lip spaced above the top surface of the board providing a slot to accommodate an edge of the sheet member. A cylindrical member located between the lip and the board is rotatably mounted on the body for rotation about an axis generally parallel to the top surface of the board. The cylindrical member has a front end facing the slot. The front end is provided with a plurality of transverse stop faces circumferentially and longitudinally spaced from each other providing a plurality of stops for aligning the sheet member with the punch mechanism in selected positions so that holes and notches can be placed in the sheet member to accommodate different types of printing presses. A control is operatively connected to the cylindrical member to rotate the cylindrical member to a selected position. The control includes a rack and gear drive operativly connected to a manually moveable knob located above the plate. The knob and plate have cooperating indicia which provide information as to the stop position of each stop face that is on the front end of the cylindrical member. A releasable holding means, such as a detent, cooperates with the control for retaining the cylindrical member in the selected position whereby one of the stop faces on the front end of the cylindrcal member provides a stop for the sheet member which aligns the sheet member with respect to the punch mechanism to replace the holes and/or notches in the sheet member in the selected position.

The adjustable stop apparatus provides the operator with the flexibility to quickly change the stop position of the stops of the punch without manually interchanging or altering the stops and maintaining the accuracy of the stops for the sheet member.

DESCRIPTION OF PREFERRED EMBODIMENT

Figure 1:
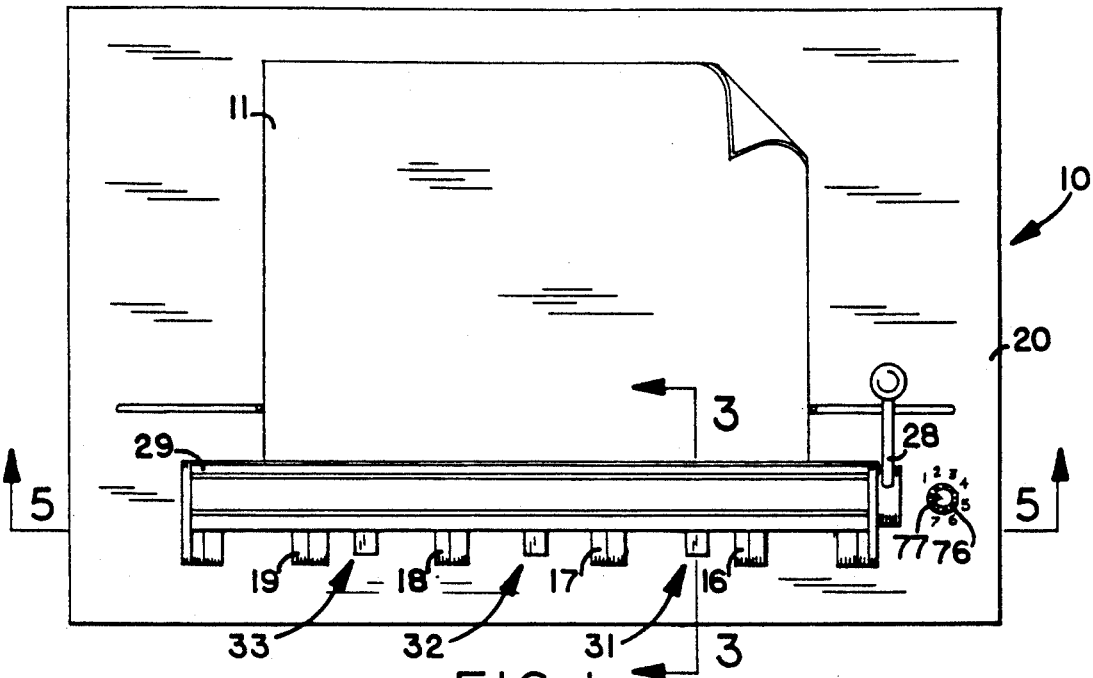
FIG. 1 is a top plan view of a register punch equipped with the adjustable stop apparatus of the invention.
Figure 2:
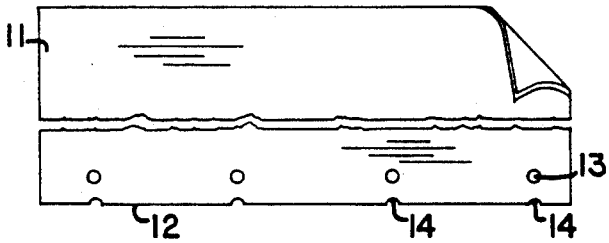
FIG. 2 is a foreshortened plan view of a sheet member, such as a printing plate, with register holes and notches made with the register punch.

Referring to FIG. 1, there is shown a top view of a register punch indicated generally at 10 for making a series of holes and notches in a sheet member 11, such as printing plates and the like. The term sheet member includes printing plates, films, negatives and sheet materials of paper, plastic and metal. As shown in FIG. 2, sheet member 11 has a linear edge 12 and a number of holes 13 along a transverse line generally parallel to the edge 12. Edge 12 has a number of semi-circular notches 14 aligned with holes 13. The holes 13 and notches 14 or half holes in sheet member 11 are for registration of printing plates and films for use with printing presses as disclosed by N. A. Ternes in U.S. Pat. 3,406,626. The number and location of the holes and notches placed in the sheet member can vary according to the requirements of the printing presses.

Register punch 10 has a plurality of punch assemblies 16, 17, 18 and 19 mounted on a board or table 20 having a flat top or work surface. The punch assemblies are identical in structure and operation. As seen in FIG. 2, each punch assembly has an eccentric cam 22 mounted on a transverse shaft 21. Cam 22 engages a pair of downwardly directed punches 23 and 24 and operates to move the lower or cutting end of the punches through holes 26 and 27 in board 20. Returning to FIG. 1, an arm or lever 28 secured to shaft 21 is used to manually rotate shaft 21 and thereby move cams 22 in a downward direction to activate punches 23 and 24. A cover 29 encloses the cams, shaft, and punches. The details of the punch assembly are not part of the invention. The adjustable stop apparatus of the invention is usable with a number of different types of sheet material punches and register punches.

As seen in FIG. 1, a plurality of adjustable stop apparatuses 31, 32 and 33 are mounted on board 20 between punch assemblies 16–19. Stop apparatuses 31–33 cooperate with the linear edge 12 of sheet member 11 to align sheet member 11 relative to the punches in selectived positions and thereby determine the locations of holes 13 and notches 14 in sheet member 11. The adjustable stop apparatuses 31–33 are identical in structure. The following description is directed to adjustable stop apparatus 31.

Figure 3:
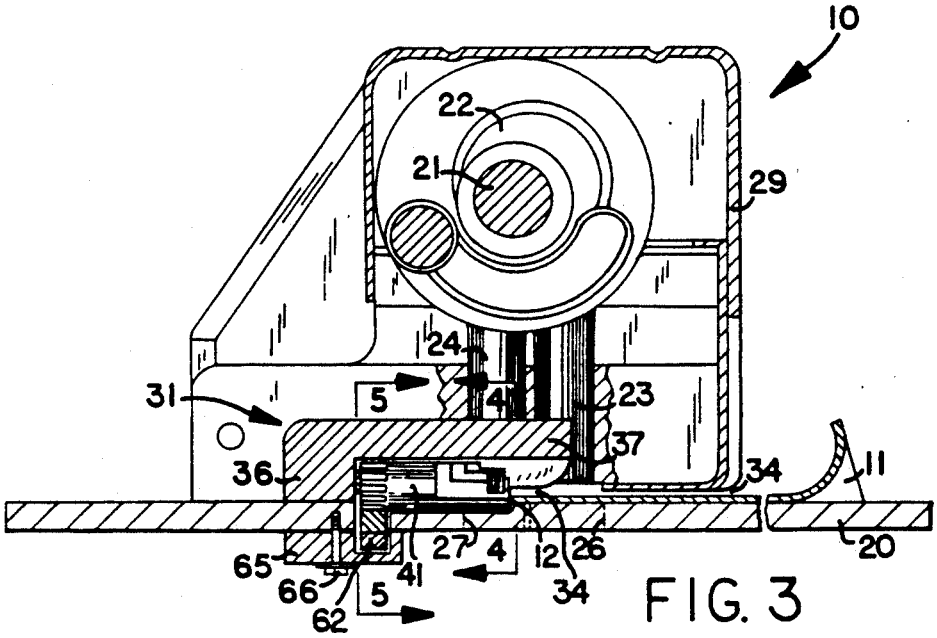
FIG. 3 is an enlarged sectional view taken along line 3—3 of FIG. 1.
Figure 4:
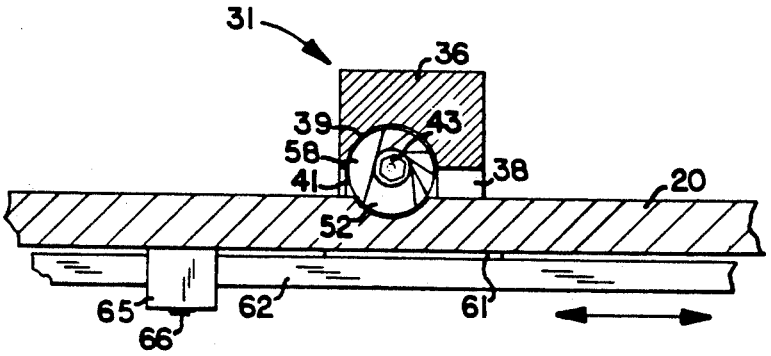
FIG. 4 is an enlarged sectional view taken along line 4—4 of FIG. 3.
Figure 8:
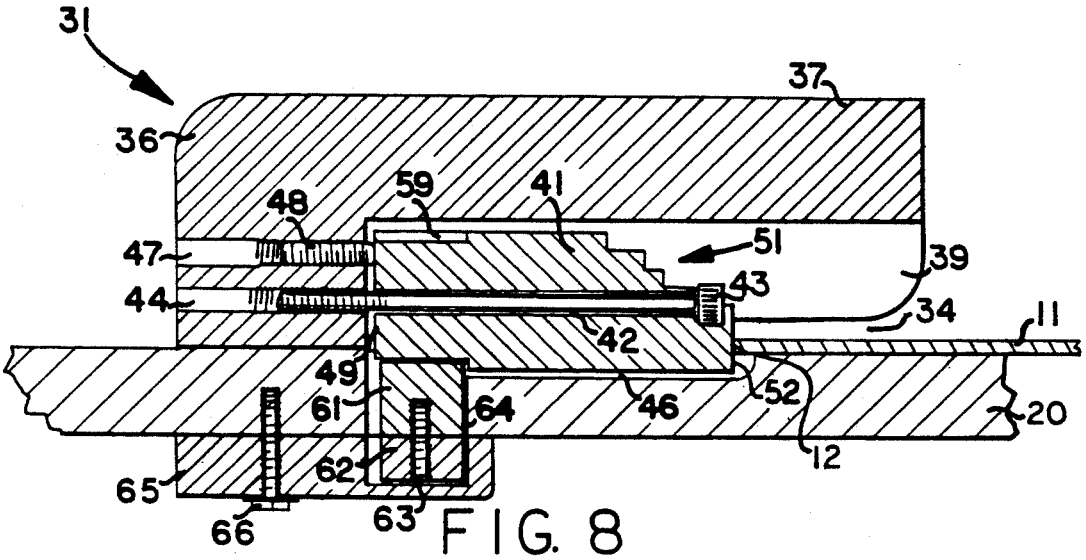
FIG. 8 is a sectional view taken along the line 8—8 of FIG. 7.

Referring to FIGS. 3 and 8, adjustable stop apparatus 31 has a body 36 attached to board 20 adjacent punch assembly 16, as seen in FIG. 1. Body 36 has a forwardly directed lip 37 located above the top surface of board 20 and forming therewith a slot 34 for accommodating an edge section of sheet member 11. The lower surface of lip 37 has a longitudinal concave recess 39 accommodating the upper portion of a cylindrical member 41. As seen in FIG. 8, cylindrical member 41 has a longitudinal axial passage 42 accommodating a rod member or bolt 43 threaded into a first threaded hole 44 to rotatably mount cylindrical member 41 on body 36 for rotation about a generally horizontal axis that is parallel to the top flat surface of board 20. Board 20 has a shallow semi-circular and concave recess 46 that accommodates a lower portion of cylindrical member 41 so that the lower front edge of cylindrical member 41 is below the top surface of board 20. This prevents sheet member 11 from sliding under cylindrical member 41.

The longitudinal position of cylindrical member 41 relative to body 36 is controlled by bolt 43 and a set screw 48 threaded into a threaded second bore 47 located above threaded bore 44. As seen in FIG. 8, set screw 48 has a forward end that bears against the back end 49 of cylindrical member 41 to prevent longitudinal movement of cylindrical member 41 on bolt 43. Set screw 48 spaces end 49 from the adjacent wall of body 37 and holds the opposite end of cylindrical member 41 in engagement with the head of bolt 43 to fix the longitudinal position of cylindrical member 41 on bolt 43 and allow rotation of cylindrical member 41 to change the stop positions for sheet member 11. Set screw 48 can be adjusted to allow bolt 43 to change the longitudinal location of cylindrical member 41 relative to body 36 to provide a fine adjustment for stop faces 52–58 at the front end 51 cylindrical member 41.

Figure 7:
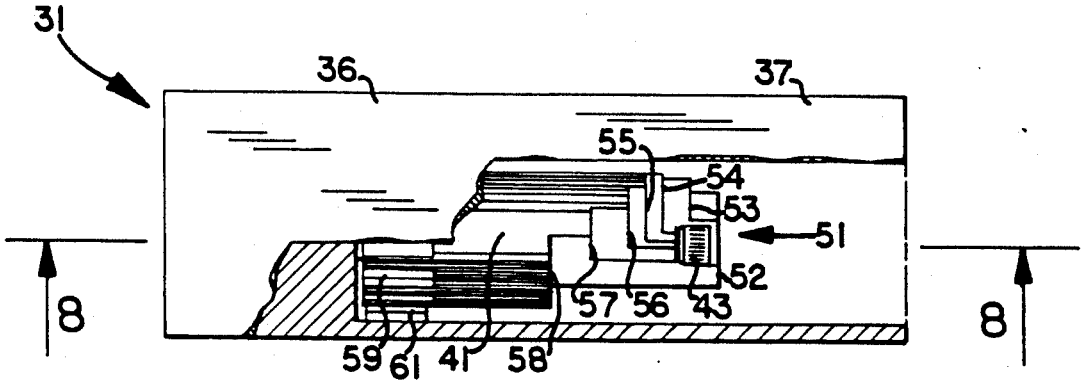
FIG. 7 is an enlarged top plan view, partly sectioned, of an adjustable stop apparatus.

As seen in FIG. 7, front end 51 of cylindrical member 41 has a plurality of circumferentially oriented and longitudinally spaced stop faces 52, 53, 54, 55, 56, 57 and 58. Stop faces 52–58 are located in a spiral stepped arrangement circumferentially around the central longitudinal axis of cylindrical member 41. Each stop face is longitudinally set back from each other to provide a different stop position for sheet member 11. Each of faces 52–58 function as a stop or an abutment engageable with edge 12 of sheet member 11 relative to punch assemblies 16–19. Front end 51 is shown as having seven separate stop faces for locating sheet member 11 in seven different punching locations as seen in FIGS. 8 and 10 to 15. The number of stop faces can vary from two or more stop faces.

A manual control mechanism is used to concurrently rotate all of the cylindrical members to present the same stop face of each cylindrical member in alignment with the slots and thereby provide stops for sheet member 11. The control mechanism operates to simultaneously rotate all of the cylindrical members of the adjustable stop apparatuses 31, 32 and 33 so that the same stop face of each cylindrical member is in alignment with the adjacent slot of the stop apparatus at the same time.

Figure 5:
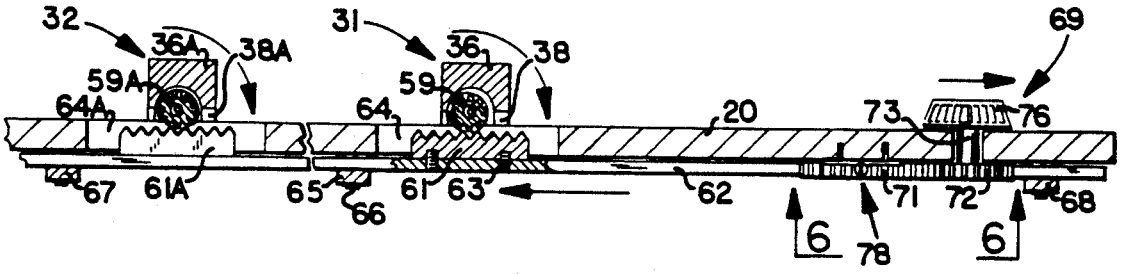
FIG. 5 is a sectional view, partly sectioned, taken along line 5—5 of FIG. 3.

As shown in FIG. 5, the control mechanism comprises a plurality of gear teeth 59 on the inner end of cylindrical member 41. Teeth 59 engage a linear rack 61 located in a linear slot 64 in board 20. Rack 61 is attached to control bar 62 with a plurality of bolts 63. Rack 61 and bar 62 can be a one piece member. Control bar 61 is slideably mounted on the bottom of board 20 with a plurality of U-shaped blocks 65, 67 and 68. Bolts 66 secure the blocks to e bottom of board 20 whereby control bar 62 is guided by the blocks for linear movement below board 20. Control bar 62 is reciprocated to change the circumferential orientation of cylindrical members of stop apparatuses 31, 32 and 33 and thereby change the stop positions for sheet member 11.

A manual control indicated generally at 69 operates to move control bar 62 to simultaneously change the angular positions of cylindrical members of stop apparatuses 31, 32 and 33. Manual control 69 comprises a linear rack 71 secured to the side of control bar 62. Rack 71 has a plurality of teeth that engage the teeth of a gear 72 attached to an upright shaft 73. Shaft 73 projects through a sleeve bearing 74 positioned in a hole in board 20 to rotatably mount shaft 73 on board 20. A knob 76 having a flat top and a cylindrical outer surface is attached to the upper end of shaft 73 to allow an operator to turn knob 76. As shown in FIG. 1, the top of knob 76 has a pointer or mark 77 aligned with one of several reference number 1–7 located on top of board 20. Reference numbers 1–7 refer to the seven stop faces 52–58 of cylindrical member 41. Knob 76 is manually turned to align pointer 77 to one of the reference numbers related to the same stop face on each cylindrical member.

Figure 6:
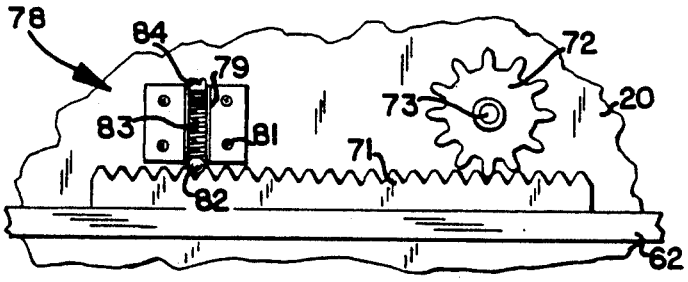
FIG. 6 is a plan view, partly sectioned, along line 6—6 of FIG. 5 in the direction of the arrows.

Control bar 62 is releasably held in a selected position with a detent indicated generally at 78. Detent 78 is a releasable holder or retainer for maintaining the selected stop positions of the cylindrical members during the punching operation. As shown in FIG. 6, detent 78 located adjacent the bottom of board 20 comprises a tube or tubular member 79 attached with fasteners 81 to the bottom of board 20. A detent ball 82 located in end of tubular member 79 engages a pair of the teeth of linear rack 71 to hold rack 71 and control bar 62 in a selected fixed position. A biasing member or spring 83 located in tubular member 79 engages a set screw or bolt 84 threaded into tubular member 79 and ball 82. Spring 83 biases ball 82 into engagement with the teeth of linear rack 71 so that ball 82 acts as a releasable stop to retain control bar 62 in a selected fixed position. The gear and rack detent drive train between knob 76 and cylindrical member 41 is coordinated such that on 30% of rotation of knob 76 there will be one change in the stop face position of cylindrical member 41. Other amounts of rotation of knob 76 can be used to change the stop faces of cylindrical member 41.

Figure 9:
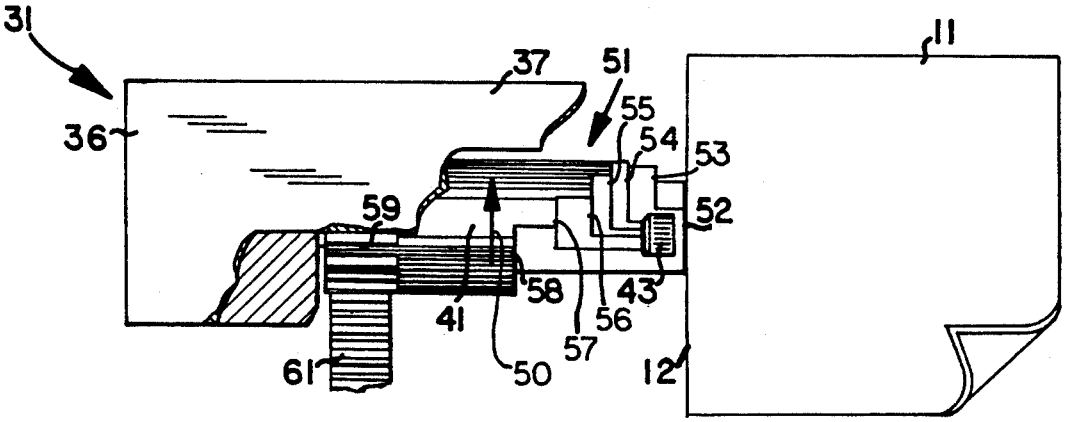
FIG. 9 is a top plan view, partly sectioned, of the adjustable stop apparatus with a sheet member located in a first stop position.
Figure 10:
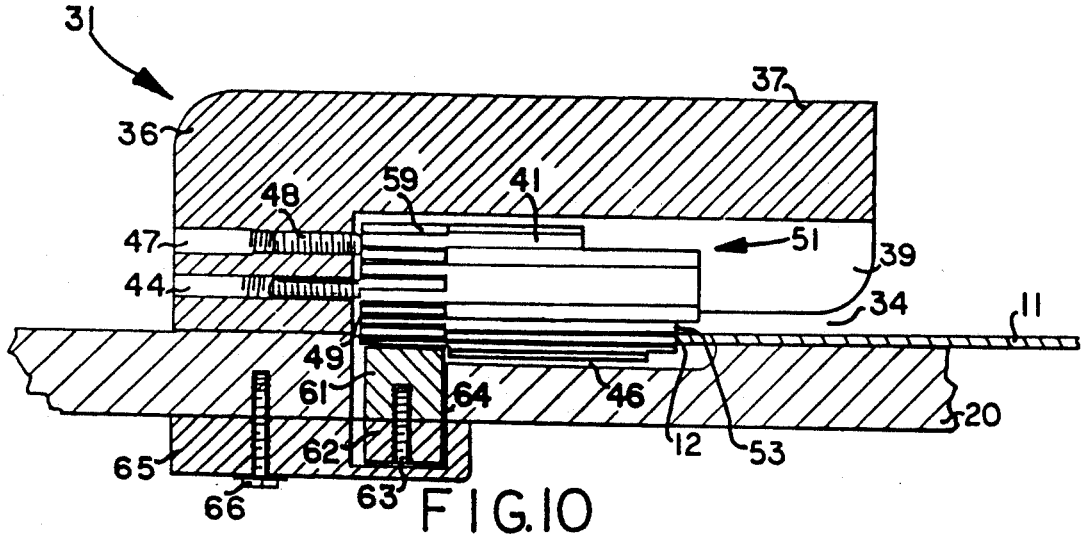
FIGS. 10 to 15 are sectional views that correspond to FIG. 8 showing the different stop positions of the sheet member.
Figure 11:
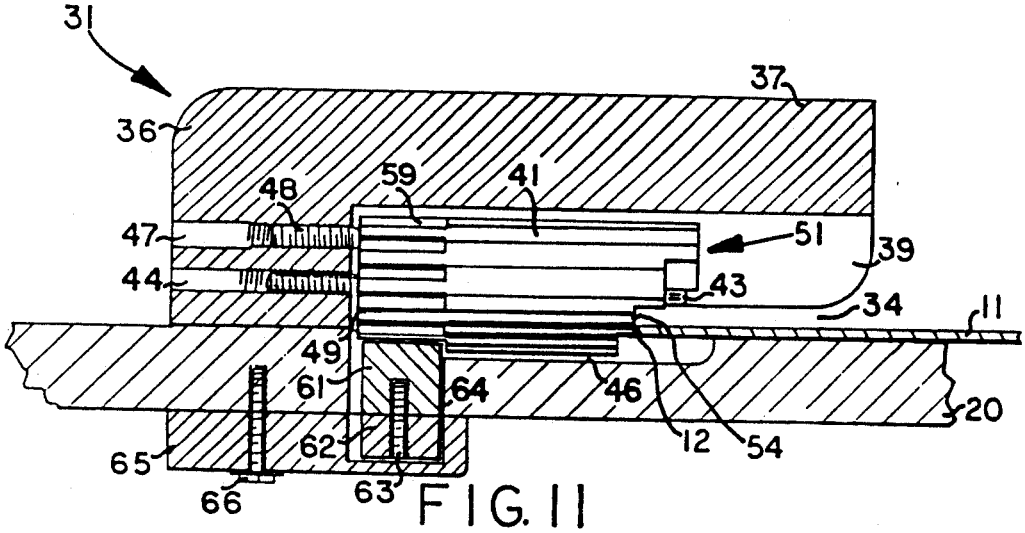
Figure 12:
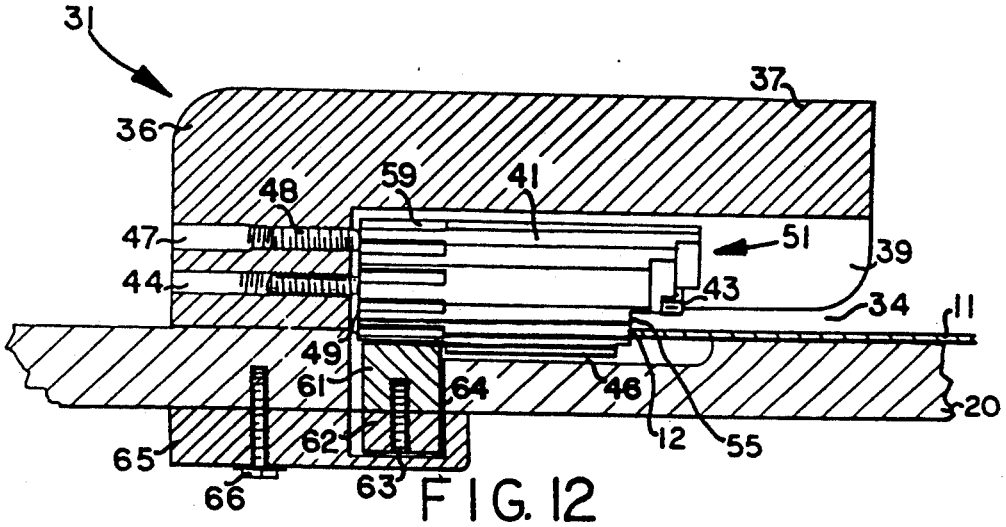
Figure 13:
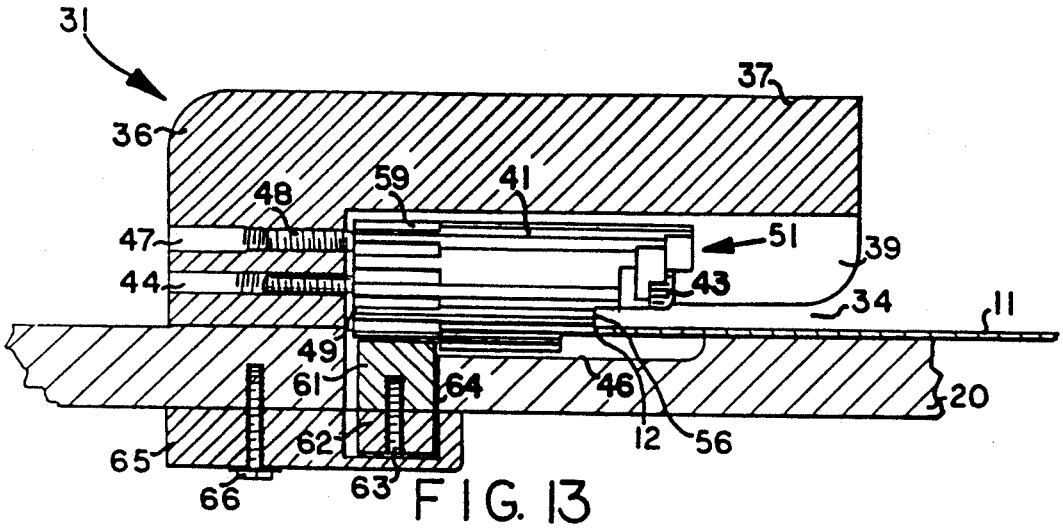
Figure 14:
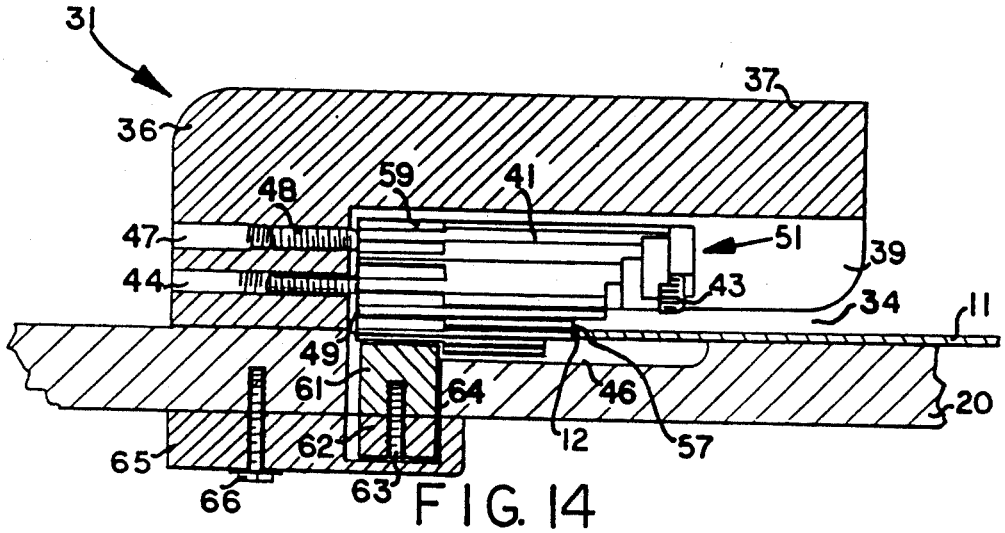
Figure 15:
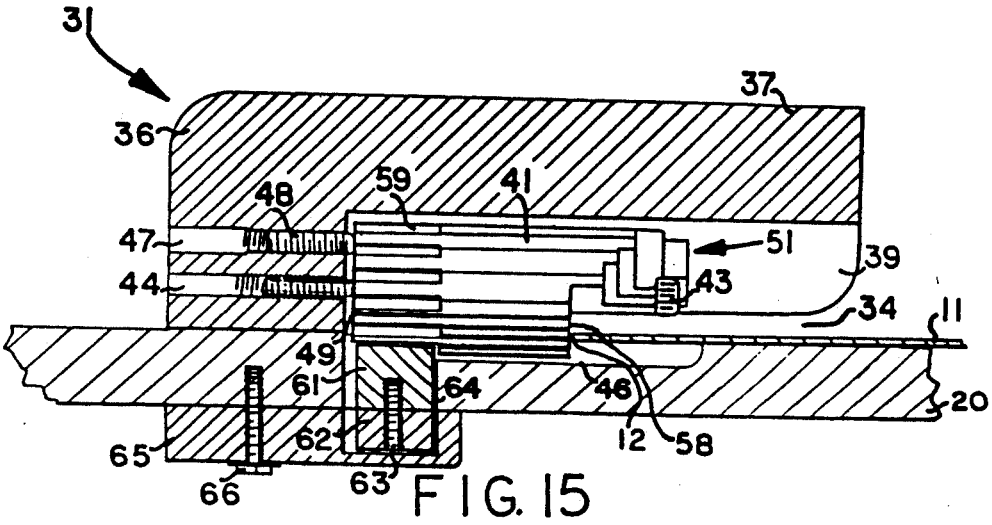

FIGS. 8 and 9 illustrate the first stop face location of stop face 52 engaged by edge 12 of sheet member 11 to fix the location relative to punches 16–19. Rack 61 attached to control bar 62 is selectively moved to rotate cylindrical member 41 to locate stop faces 52–58 selectively in alignment with slot 34 so that edge 12 of sheet member 11 will be located in a selected stop position. FIG. 9 shows edge 12 of sheet member 11 in engagement with stop face 52. Rotation of knob 76 to the next numbered position rotates member 41 in the direction of arrow 50 to place stop face 53 in alignment with edge 12 of sheet member as seen in FIG. 10. Continued rotation of member 41 moves stop face 54 in alignment with groove 34 to provide a third stop position for sheet member 11 as seen in FIG. 11. Further rotation of knob 76 moves stop face 55 into position for engagement with edge 12 of sheet member 11 to provide a fourth stop position for stop member 11 as seen in FIG. 12. Additional stop positions for sheet member 11 are determined by locating stop faces 56, 57 and 58 in alignment with groove 34 as seen in FIGS. 13, 14 and 15. Stop face 58 is the last stop location for sheet member 11. Knob 76 is rotated by the operator to select the same stop position of all stop apparatuses 31–33 for sheet member 11.

When the stop position of sheet member 11 has been determined, sheet member 11 is moved into slots 34 until edge 12 engages the selected stop faces on the cylindrical members. Punch assemblies 16–19 are then simultaneously moved downwardly by moving arm 28 and thereby moving the punches which cut holes and notches in sheet member 11. Punch assemblies 16–10 can be used to only cut holes in the sheet member. The location of the holes and notches relative to edge 12 of sheet member 11 is determined by all of the same stop position of the cylindrical members of stop apparatuses 31, 32 and 33.

While there have been shown and described a preferred embodiment of the adjustable stop apparatus for a register punch, it is understood that changes and additions can be made to the stop apparatus and punch without deviating from the invention. The invention is defined in the following claims.

We claim:

1. An adjustable stop apparatus for a punch having a board with a top surface and punch means for placing at least one hole in a sheet member comprising: a body mounted on the board adjacent the punch means, said body having a lip spaced above the top surface of the board providing a slot to accommodate an edge of the sheet member, a cylindrical member located between the lip and board, means rotatably mounting the cylindrical member on said body for rotation about an axis generally parallel to the top surface of the board, said cylindrical member having a front end facing said slot, said front end having a plurality of transverse faces circumferentially and longitudinally spaced from each other providing stops for aligning the sheet member with the punch means in selected positions, means operably connected to the cylindrical member to rotate the cylindrical member to a selected position, and means for retaining the cylindrical member in the selected position whereby one of the faces on the front end of the cylindrical member provides a stop for the sheet member which aligns the sheet member with respect to the punch means to place at least one hole in the sheet member in a selected position.

2. The apparatus of claim 1 wherein: said body has a first recess for accommodating part of said cylindrical member, said board having a second recess for accommodating another part of the cylindrical member to align the face providing a stop with the top surface of the board.

3. The apparatus of claim 1 wherein: said board includes a concave recess for accommodating a portion of the cylindrical member to align the face providing a stop with the top surface of the board.

4. The apparatus of claim 1 wherein: the cylindrical member has a longitudinal passage, said means rotatably mounting the cylindrical member on said body includes rod member extended through said passage whereby said cylindrical member is rotatably mounted on the rod member.

5. The apparatus of claim 4 including: means mounted on the body engagable with said cylindrical member to adjust the position of the cylindrical member relative to said body.

6. The apparatus of claim 5 wherein: the means mounted on the body includes a set screw located in a threaded bore in the body and engagable with said cylindrical member, said set screw being adjustable to allow adjustment of the cylindrical member relative to the body.

7. The apparatus of claim 4 wherein: said plurality of transverse faces extend outwardly from said bore and are circumferentially orientated relative to said bore.

8. The apparatus of claim 4 wherein: the cylindrical member has gear teeth, said means operably connected to the cylindrical member including movable means having teeth engagable with said gear teeth whereby on movement of the movable means the cylindrical member is rotated to a selected position.

9. The apparatus of claim 8 wherein: the movable means includes a control bar and a rack having said teeth engagable with said gear teeth, and means to move said control bar thereby rotate said cylindrical member.

10. The apparatus of claim 9 wherein: the means to move said control bar includes rack and gear drive means and a knob operably connected to the gear drive means, said knob being rotatable to operate the gear drive means to move the control bar thereby rotate the cylindrical member.

11. The apparatus of claim 10 wherein: the means for retaining the cylindrical member in the selected position includes releasable detent means engagable with said rack and gear drive means.

12. The apparatus of claim 10 including: indicia means associate with the knob providing information to the operator oi the punch of the selected stop for the sheet member.

13. An adjustable stop apparatus for a punch having a board with a top surface and punch means placing at least one hole in a sheet member comprising: a body mounted on the board providing a slot with said top surface of the board for accommodating an edge portion of the sheet member to locate said edge portion relative to the punch means, first means rotatably mounted on the body having a front end facing said slot, said front end having a plurality of transverse faces circumferentially and longitudinally spaced from each other providing stop for aligning the edge portion of the sheet member with the punch means in selected positions, second means rotatably mounting the first means on the body, third means operably connected to the first means to rotate the first means to a selected position, and fourth means for retaining the first means in the selected position whereby one of the faces of the front end of the first means provides a stop for the sheet member which aligns the edge portion of the sheet member with respect to the punch means to place at least one hole in the sheet member in a selected position.

14. The apparatus of claim 13 wherein: said body has a first recess for accommodating part of said first means, said board having a second recess for accommodating another part of the first means to align the face providing the stop with the top surface of the board.

15. The apparatus of claim 13 wherein: said board includes a recess below said body for accommodating a portion of the first means to align the face providing a stop with the top surface of the board.

16. The apparatus of claim 13 wherein: the first member has a longitudinal passage, said second means mounting the first member on said body includes a rod member extended through said passage whereby said first means is rotatably mounted on the rod member.

17. The apparatus of claim 16 including: fifth means mounted on the body engagable with the first means to adjust the position of the first means relative to the body.

18. The apparatus of claim 17 wherein: the fifth means includes a set screw located in a threaded bore in the body and engagable with the first means, said set screw being adjustable to allow adjustment of the first means relative to the body.

19. The apparatus of claim 16 wherein: said plurality of transverse faces extend outwardly from said board and are circumferentially oriented to said bore.

20. The apparatus of claim 16 wherein: the first means has gear teeth, said third means operatively connected to the first means including a movable means having teeth engagable with said gear teeth whereby on movement of the movable means the first means is rotated to a selected position.

21. The apparatus of claim 20 wherein: the movable means includes a control bar and a rack having said teeth engagable with said gear teeth, and means to move said control bar thereby rotate said first means.

22. The apparatus of claim 21 wherein: the means to move said control bar includes a rack and gear drive means and a knob operably connected to the gear drive means, said knob being rotatable to operate the gear drive means to move the control bar thereby rotate the cylindrical member.

23. The apparatus of claim 22 wherein: the means for retaining the cylindrical member in the selected position includes releasable detent means engagable with said rack and gear drive means.

24. The apparatus of claim 22 including: indicia means associate with the knob providing information to the operator of the punch of the selected stop for the sheet member.

* * * * *